US008624474B2

(12) United States Patent
Kyuno et al.

(10) Patent No.: US 8,624,474 B2
(45) Date of Patent: Jan. 7, 2014

(54) SPARK PLUG

(75) Inventors: Jiro Kyuno, Aichi (JP); Akira Suzuki, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 13/580,170

(22) PCT Filed: Sep. 28, 2010

(86) PCT No.: PCT/JP2010/005809
§ 371 (c)(1),
(2), (4) Date: Aug. 21, 2012

(87) PCT Pub. No.: WO2011/104785
PCT Pub. Date: Sep. 1, 2011

(65) Prior Publication Data

US 2012/0306346 A1 Dec. 6, 2012

(30) Foreign Application Priority Data

Feb. 26, 2010 (JP) ..... 2010-041755

(51) Int. Cl.
*H01T 13/20* (2006.01)

(52) U.S. Cl.
USPC ..... 313/141; 313/118; 313/143

(58) Field of Classification Search
USPC ..... 313/118, 132, 135, 141–144
See application file for complete search history.

(56) References Cited

U.S. PATENT DOCUMENTS

| | | | | |
|---|---|---|---|---|
| 2002/0024160 | A1 * | 2/2002 | Sugimoto | 264/12 |
| 2006/0022566 | A1 | 2/2006 | Ishiguro | 313/143 |
| 2006/0284535 | A1 * | 12/2006 | Ozeki et al. | 313/143 |
| 2010/0096968 | A1 * | 4/2010 | Ban et al. | 313/141 |
| 2011/0043094 | A1 * | 2/2011 | Suzuki | 313/144 |
| 2011/0304256 | A1 * | 12/2011 | Nakamura et al. | 313/141 |

FOREIGN PATENT DOCUMENTS

| | | | |
|---|---|---|---|
| JP | 11-345676 | 12/1999 | H01T 13/08 |
| JP | 2006-66385 | 3/2006 | H01T 13/36 |

OTHER PUBLICATIONS

Form PCT/ISA/210—Int'l Search Report (from corresponding Int'l Patent App. No. PCT/JP2010/005809—English version only); 1 page.

* cited by examiner

*Primary Examiner* — Anh Mai
*Assistant Examiner* — Kevin Quarterman
(74) *Attorney, Agent, or Firm* — Kusner & Jaffe

(57) ABSTRACT

A spark plug having a metal shell, the metal shell having a tool engagement portion, a trunk portion and a cylindrical groove disposed between the tool engagement portion and the trunk portion, wherein the following relationship is satisfied:

$Z1 <= Z2$, where "Z1" represents a section modulus of a first groove end of the groove, and where "Z2" represents a section modulus of a second groove end of the groove.

6 Claims, 5 Drawing Sheets

20··· Ceramic insulator
30··· Metal shell
34··· Trunk portion
35··· Groove
353··· First groove end
355··· Outermost portion
357··· Second groove end
36··· Tool engagement portion
363··· Engagement face
364··· Engagement face
38··· Caulking portion
50··· Gasket
62··· Packing
63··· Filled-up portion
64··· Packing
A··· Distance
B··· Distance
C··· Thickness
D··· Distance
H··· Distance

Fig. 4

| Sample No. | First groove end Section Modulus Z1 ($mm^3$) | Second groove end Section Modulus Z2 ($mm^3$) | Relationship between Distance A and Distance B | Presence/Absence of Crack and Cracking Position |
|---|---|---|---|---|
| 11 | 71 | 74 | A<B | Absence |
| 12 | 71 | 71 | A=B | Absence |
| 13 | 71 | 66 | A>B | Absence |
| 21 | 66 | 71 | A<B | Absence |
| 22 | 66 | 66 | A=B | Absence |
| 23 | 66 | 62 | A>B | Absence |
| 31 | 62 | 66 | A<B | Absence |
| 32 | 62 | 62 | A=B | Absence |
| 33 | 62 | 58 | A>B | Presence/B side |
| 41 | 58 | 62 | A<B | Absence |
| 42 | 58 | 58 | A=B | Absence |
| 43 | 58 | 53 | A>B | Presence/B side |
| 51 | 53 | 58 | A<B | Absence |
| 52 | 53 | 53 | A=B | Absence |
| 53 | 53 | 49 | A>B | Presence/B side |
| 61 | 49 | 53 | A<B | Absence |
| 62 | 49 | 49 | A=B | Presence/B side |
| 63 | 49 | 45 | A>B | Presence/B side |
| 71 | 45 | 49 | A<B | Presence/A side |
| 72 | 45 | 45 | A=B | Presence/B side |

Fig. 5

| Sample No. | Trunk portion Thickness C1 (mm) | Presence/Absence of Crack |
|---|---|---|
| 81 | 4.0 | Absence |
| 82 | 3.5 | Absence |
| 83 | 3.0 | Absence |
| 84 | 2.5 | Presence |
| 85 | 2.0 | Presence |

Fig. 6

| Sample No. | Bulging Ratio of Groove (H/D) | Presence/Absence of Crack |
|---|---|---|
| 91 | 0.14 | Absence |
| 92 | 0.15 | Absence |
| 93 | 0.16 | Absence |
| 94 | 0.17 | Absence |
| 95 | 0.18 | Presence |

SPARK PLUG

FIELD OF THE INVENTION

The present invention relates to a spark plug used for igniting fuel through generating a spark electrically in an internal combustion engine.

BACKGROUND OF THE INVENTION

A conventional spark plug typically has a metal shell that is fixed by caulking to an outer circumference of a ceramic insulator that holds a center electrode therein (See, for example, Japanese Patent Application Laid-Open (kokai) No. 11-345676). Such metal shell of the spark plug has a pair of flanges projecting in an outer circumference direction. During a "caulking process," a cylindrical groove, bulging out in the outer circumference direction, is formed between the flanges. Examples of the flanges in the metal shell are a tool engagement portion assuming a polygonal-shape for engaging with a tool for mounting a spark plug to an engine head, or a trunk portion for compressing a gasket towards an engine head.

Recently, a reduction in size of a spark plug is considered as one of the various resolutions of fuel efficiency improvement in an internal combustion engine and of emission gas reduction. However, deterioration in strength of the metal shell has not been considered in connection with the miniaturization of the spark plug. For example, when the metal shell is miniaturized with the same reduction ratio as that of the spark plug, the strength of a groove in the metal shell could not fully be achieved, which may lead to a crack due to impact or stress corrosion.

In light of the above-described problems, an object of the present invention is to provide a technique capable of reducing the size of a spark plug while securing the integrity of the groove in the metal shell.

SUMMARY OF THE INVENTION

The present invention has been conceived to solve, at least partially, the above problem and can be embodied in the following modes or application examples.

Aspect 1

In accordance with a first aspect of the present invention, there is provided a spark plug comprising: a rod-like center electrode; a ceramic insulator electrically insulating an outer circumference of the center electrode; and a metal shell fixed by caulking to an outer circumference of the ceramic insulator. The metal shell includes a cylindrical groove that bulges out in an outer circumference direction. A polygonal tool engagement portion adjoins one end of the groove and bulges out in the outer circumference direction with respect to the groove. A trunk portion adjoins another end (which is different to the one end) of the groove and bulges out in the outer circumference direction with respect to the groove. A ground electrode is joined to the metal shell and forms a spark gap with the center electrode, wherein an opposite side distance "S" between opposing two sides of the polygonal tool engagement portion is 12 mm or less, wherein a section modulus "Z1" and a section modulus "Z2" satisfy a relationship: Z1<=Z2, where "Z1" represents a section modulus in the one end of the groove, and where "Z2" represents a section modulus in the other end of the groove.

Aspect 2

In accordance with another aspect of the present invention, there is provided a spark plug according to Aspect 1, wherein the section modulus "Z1" preferably satisfy a relationship Z1>=49 mm3.

Aspect 3

In accordance with another aspect of the present invention, there is provided a spark plug as described above according to Aspects 1 or 2, wherein a distance A, a distance B and the section modulus "Z2" preferably satisfy the following relationship:

$$\text{if } A>B, Z2>=62\ \text{mm}^3,$$

$$\text{if } A<=B, Z2>=53\ \text{mm}^3,$$

where the distance "A" represents a distance from the one end to an outermost portion having a largest outer diameter in the groove, and where the distance "B" represents a distance from the other end to the outermost portion.

Aspect 4

In accordance with another aspect of the present invention, there is provided a spark plug as described above according to any one of Aspects 1 to 3, wherein a thickness "C" preferably satisfy the relationship:

$$C>=3\ \text{mm},$$

where the thickness "C" represents a thickness of the trunk portion along an axis of the center electrode from a region adjoining the other end of the groove.

Aspect 5

In accordance with another aspect of the present invention, there is provided a spark plug as described above according to any one of Aspects 1 to 4, wherein a distance "D" and a distance "H" preferably satisfy the following relationship:

$$(H/D)<=0.17,$$

where the distance "D" represents a distance from the one end to the other end of the groove, and where the distance "H" represents a distance from the outermost portion to a straight line that connects the one end to the other end of the groove.

Aspect 6

In accordance with another aspect of the present invention, there is provided a spark plug as described above according to any one of Aspects 1 to 5, wherein the metal shell may be plated with nickel.

Aspect 7

In accordance with another aspect of the present invention, there is provided a spark plug as described above according to any one of Aspects 1 to 6, wherein the fixation by caulking may be conducted through a cold caulking.

The present invention can be implemented in various forms. For example, the present invention can be implemented not only in a spark plug but also, for example, in a metal shell of a spark plug, an internal combustion engine in which the spark plug is mounted, and in a method for manufacturing a spark plug. Further, the present invention is not limited to the above-described aspects, but may be embodied in various other forms without departing from the gist of the invention.

According to a spark plug of Aspect 1, the impact resistance of the groove is securable, i.e., obtainable, even though the opposite side distance of the tool engagement portion is 12 mm or less. Therefore, the spark plug can be miniaturized while securing the strength of the groove of the metal shell.

According to the spark plug of Aspect 2, the impact resistance of the groove is fully securable.

According to the spark plug of Aspect 3, the impact resistance of the groove is fully securable corresponding to the relationship between the distance A that is from the outermost portion to the one end of the groove and the distance B that is from outermost portion to the other end of the groove.

According to the spark plug of Aspect 4, impact exerted on the groove can be alleviated.

According to the spark plug of Aspect 5, resistance to stress corrosion cracking can be improved.

According to the spark plug of Aspect 6, although the metal shell is plated by nickel that tends to cause cracks due to stress corrosion, the spark plug can be miniaturized while securing the intensity, i.e., strength, of the groove of the metal shell.

According to the spark plug of Aspect 7, the spark plug can be miniaturized while maintaining the strength of the groove of the metal shell, even though the cold caulking, which tends to cause an asymmetry of the bulging of the groove across the outermost portion, is adopted for fixing the metal shell.

BRIEF DESCRIPTION OF THE DRAWINGS

FIG. 4 is an explanatory view showing the result of the evaluation regarding an influence of a section modulus and a distance of the groove on impact resistance properties of the spark plug.

FIG. 5 is an explanatory view showing the result of the evaluation regarding an influence of a thickness of the trunk portion on impact resistance properties of the spark plug.

FIG. 6 is an explanatory view showing the result of the evaluation regarding an influence of a bulging ratio of the groove on stress-corrosion-crack-resistance properties of the spark plug.

DETAILED DESCRIPTION OF PREFERRED EMBODIMENTS

In order to further define the configuration and the effect of the present invention described above, a spark plug according to the present invention will next be described with reference to specific embodiments.

A. Embodiment

A-1. Configuration of Spark Plug

Figure 1:
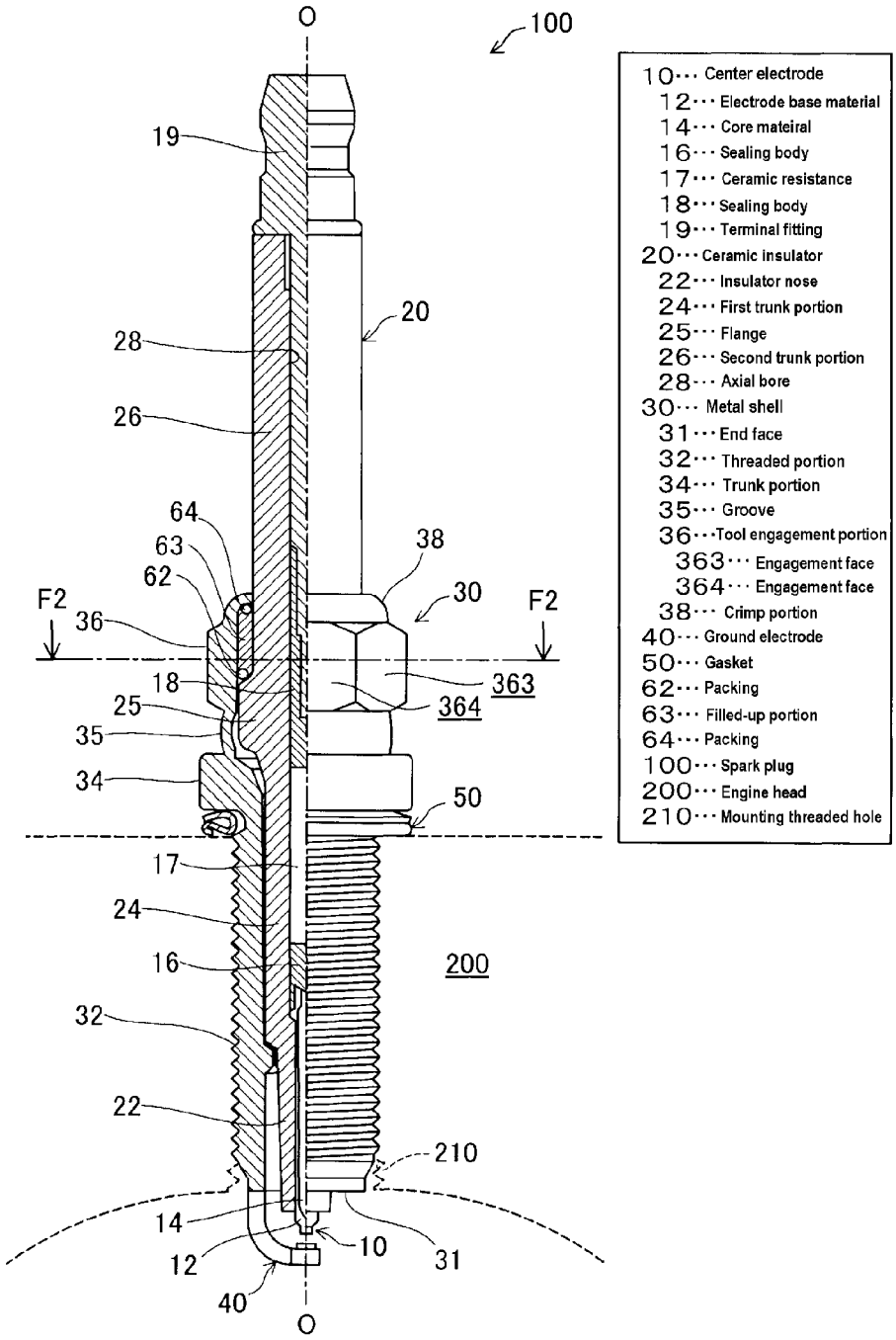
FIG. 1 is a partially sectioned view of a spark plug.

FIG. 1 is a partially sectioned view of a spark plug 100. In FIG. 1, the spark plug 100 is divided into two sections bordered by an axis O-O of the spark plug 100—one side showing an outer appearance of the spark plug 100 and the other side showing a cross-section of the spark plug 100. The spark plug 100 includes a center electrode 10, a ceramic insulator 20, a metal shell 30 and a ground electrode 40. In this embodiment, the axis O-O of the spark plug 100 also acts as an axis of the center electrode 10, ceramic insulator 20 and the metal shell 30.

In the spark plug 100, an outer circumference of the rod-like center electrode 10 is insulated by the ceramic insulator 20. One end of the center electrode 10 projects from one end of the ceramic insulator 20 and the other end of the center electrode 10 is electrically connected to the other end of the ceramic insulator 20. An outer circumference of the ceramic insulator 20 is held by the metal shell 30 through caulking. with being Metal shell 30 is electrically insulated from the center electrode 10. The ground electrode 40 is electrically connected to the metal shell 30 and forms a spark gap for generating sparks, in cooperation with the center electrode 10. The spark plug 100 is mounted on a mounting threaded hole 210 provided in an engine head 200 of an internal combustion engine (not shown) with the metal shell 30 being engaged with the mounting threaded hole 210. When a high voltage of 20,000 volts to 30,000 volts is applied to the center electrode 10, a spark is generated across the spark gap formed between the center electrode 10 and the ground electrode 40.

The center electrode 10 of the spark plug 100 is a rod-like electrode having a structure in which a core 14 is embedded within an electrode base metal 12 to have a closed-bottomed tubular shape. Core 14 is superior in thermal conductivity to the electrode base metal 12. In the present embodiment, the center electrode 10 is held by the ceramic insulator 20 with one end of the electrode base metal 12 projecting from the one end of the ceramic insulator 20 and electrically connected to the other end of the ceramic insulator 20 through a sealing body 16, a ceramic resistance 17, a sealing body 18 and a terminal fitting 19. In a preferred embodiment, the electrode base metal 12 is formed of a nickel alloy, such as INCONEL (registered trademark), which contains nickel as a main component. The core 14 of the center electrode 10 is formed of copper or an alloy which contains copper as a main component.

The ground electrode 40 of the spark plug 100 is welded to the metal shell 30 and bent in a direction perpendicular to the axis O-O of the center electrode 10 so as to face a front end of the center electrode 10. In the present embodiment, the ground electrode 40 is formed of a nickel alloy, such as INCONEL (registered trademark), which contains nickel as a main component.

The ceramic insulator 20 of the spark plug 100 is formed from a ceramic material, such as alumina, by firing. The ceramic insulator 20 is a tubular member having therein an axial bore 28 for accommodating the center electrode 10. The ceramic insulator 20 has an insulator nose 22, a first trunk portion 24, a flange 25 and a second trunk portion 26 in this order along the axis O-O from a side where the center electrode 10 projects. The insulator nose 22 of the ceramic insulator 20 assumes a tubular form whose outer diameter reduces towards the side where the center electrode 10 projects. The first trunk portion 24 of the ceramic insulator 20 assumes a tubular form whose outer diameter is larger than that of the insulator nose 22. The flange 25 of the ceramic insulator 20 assumes a tubular form whose outer diameter is larger than that of the first trunk portion 24. The second trunk portion 26 of the ceramic insulator 20 assumes a tubular form whose outer diameter is smaller than that of the flange 25 and provides a sufficient distance between the metal shell 30 and the terminal fitting 19.

Although the metal shell 30 of the spark plug 100 is made of nickel-plated low-carbon steel in this embodiment, it may be zinc-plated low-carbon steel or a non-plated-nickel alloy in other embodiments. In this embodiment, although the metal shell 30 was fixed by caulking to the ceramic insulator 20 through cold caulking, it may be fixed through thermal caulking in other embodiments.

The metal shell 30 has an end face 31, a threaded portion 32, a trunk portion 34, a groove 35, a tool engagement portion 36 and a caulking portion 38 in this order along the axis O-O from the side where the center electrode 10 projects. The end face 31 of the metal shell 30 is a hollow cylindrical face formed at the front end of the threaded portion 32. The ground electrode 40 is joined to the end face 31, and the center electrode 10 surrounded by the insulator nose 22 of the ceramic insulator 20 projects from the center of the end face 31. The cylindrical threaded portion 32 of the metal shell 30 has a screw thread on its outer circumference which is threadingly engaged with the mounting threaded hole 210 of the engine head 200. The caulking portion 38 of the metal shell 30 is subjected to plastic working and is located adjacent to the tool engagement portion 36 so as to fit with the second trunk portion 26 of ceramic insulator 20 when the metal shell 30 is caulked to the ceramic insulator 20. A filled-up portion 63, that is filled with talc powder, is formed in a region between the caulking portion 38 of the metal shell 30 and the flange 25 of the ceramic insulator 20. The filled-up portion 63 is sealed by packings 62 and 64.

The groove 35 of the metal shell 30 is provided between the trunk portion 34 and the tool engagement portion 36. The groove 35 bulges out in an outer circumference direction when the metal shell 30 is fixed by caulking to the ceramic insulator 20. In this embodiment, the bulging groove 35 assumes a curving shape in the outer circumference direction due to cold caulking. When the thermal caulking is adopted, this shape is resulted from compression. The trunk portion 34 of the metal shell 30 is provided adjacent to the groove 35 and assumes a flange-like shape projecting in the outer circumference direction with respect to the groove 35 so as to compress the gasket 50 towards the engine head 200. The tool engagement portion 36 of the metal shell 30 is provided adjacent to the groove 35 and assumes a flange-like shape projecting in the outer circumference direction with respect to the groove 35. The tool engagement portion 36 assumes a polygonal shape so as to allow a tool (not shown) to be engaged therewith for mounting the spark plug 100 to the engine head 200. Although the tool engagement portion 36 assumes a hexagonal shape in this embodiment, it may assume a polygonal shape, such as quadrangular and octagonal shapes, in other embodiments.

Figure 2:
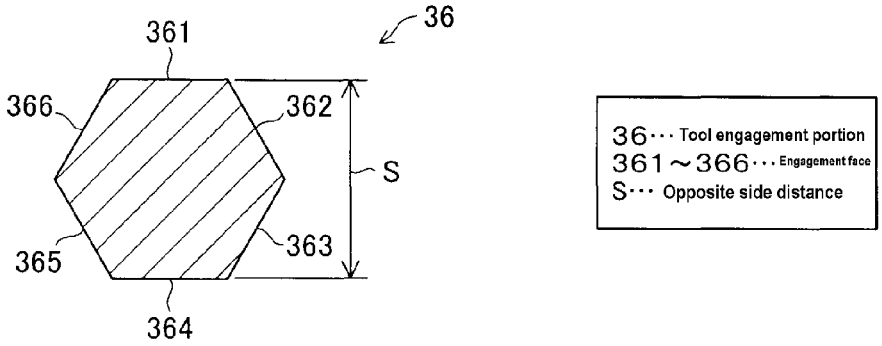
FIG. 2 is a sectioned view showing a tool engagement portion of a metal shell viewed in a direction along an axis of the spark plug.

FIG. 2 is a sectioned view showing the tool engagement portion 36 of the metal shell 30 as viewed in a direction along the axis O-O of the spark plug 100. The sectioned face in FIG. 2 shows the tool engagement portion 36 taken along arrows F2-F2 of FIG. 1. As shown in FIG. 2, the tool engagement portion 36 is formed into a hexagonal shape in this embodiment so as to correspond to a hexagonal wrench (not shown). The tool engagement portion 36 has six engagement faces 361, 362, 363, 364, 365 and 366 in a clockwise direction. In this embodiment, each opposite side distance "S" between the opposite sides of the six engagement faces—i.e., the engagement faces 361 and 364, the engagement faces 362 and 365, and the engagement faces 363 and 366, is 12 mm. However, the opposite side distance "S" may be smaller than 12 mm, such as 11 mm, 10 mm and 9 mm, in other embodiments.

Figure 3:
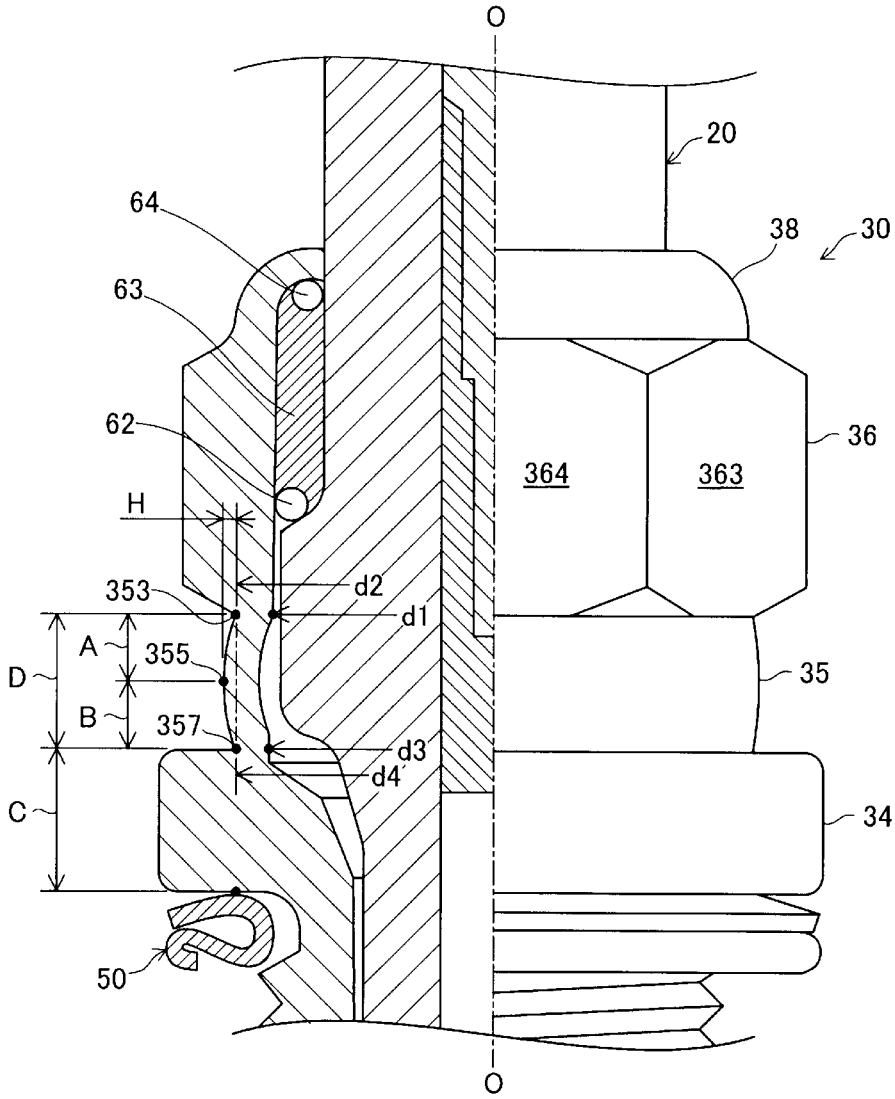
FIG. 3 is a partially expanded section view showing the tool engagement portion, a groove and a trunk portion of the metal shell in the spark plug.

FIG. 3 is an enlarged, section view showing the tool engagement portion 36, the groove 35 and the trunk portion 34 of the metal shell 30 in the spark plug 100. The groove 35 of the metal shell 30 includes a first groove end 353, an outermost portion 355 and a second groove end 357. The first groove end 353 of the groove 35 is located adjacent to the tool engagement portion 36 of the metal shell 30. The outermost portion 355 of the groove 35 is disposed between first groove end 353 and second groove end 357 and has a largest outer diameter in the groove 35. The second groove end 357 of the groove 35 is located adjacent to the trunk portion 34 of the metal shell 30.

The relationship between a section modulus "Z1" and a section modulus "Z2" preferably satisfy the following relationship:

$$Z1<=Z2,$$

where the section modulus "Z1" relates to the axis O-O in the first groove end 353 of the groove 35, and where the section modulus "Z2" relates to the axis O-O in the second groove end 357 of the groove 35.

In addition, the section modulus "Z1" is represented by the following expression 1, and the section modulus "Z2" is represented by the following expression 2.

$$[Z1=(\pi/32)\cdot[\{(d2)^4-(d1)^4\}/(d2)] \quad (1)$$

$$Z2=(\pi/32)\cdot[\{(d4)^4-(d3)^4\}/(d4)] \quad (2)$$

The "d1" in the expression 1 shows an inner diameter of the first groove end 353, and the "d2" shows an outer diameter of the first groove end 353. The "d3" in the expression 2 shows an inner diameter of the second groove end 357, and the "d4" shows an outer diameter of the second groove end 357.

The section modulus Z1 in the first groove end 353 of the groove 35 preferably satisfies a relationship: Z1>=49 $mm^3$. The section modulus Z2 in the second groove end 357 of the groove 35 preferably satisfies a relationship:

$$\text{if } A>B, Z2>=62\ mm^3;\ \text{and}$$

$$\text{if } A<=B, Z2>=53\ mm^3,$$

where "A" represents a distance along the axis O-O from the first groove end 353 to the outermost portion 355 of the groove 35, and where "B" represents a distance along the axis O-O from the outermost portion 355 of the groove 35 to the second groove end 357. Evaluated value of the section modulus Z1 and that of Z2 will be mentioned later.

Regarding the shape of trunk portion 34, a thickness C from a portion adjacent to the second groove end 357 of the groove 35 to the trunk portion 34 along the axis O-O preferably satisfies a relationship: C>=3.0 mm. An evaluated value of the thickness C of the trunk portion 34 will be mentioned later.

The relationship between a distance "D" and a distance "H" preferably satisfies:

$$(H/D)<=0.17,$$

where "D" represents a distance from the first groove end 353 to the second groove end 357 of the groove 35 along the axis O-O, and where "H" represents a distance from the outermost portion 355 to a straight line connecting the first groove end 353 to the second groove end 357 of the groove 35. An evaluated value of a bulging ratio (H/D) of the groove 35 that bulges out in the outer circumference direction will be mentioned later.

A-2. Evaluated Value of Section Modulus Z1, Z2 of Groove 35

FIG. 4 is an explanatory view showing the result of the evaluation regarding an influence of the section modulus Z1, Z2 and the distance A, B of the groove 35 on impact resistance properties of the spark plug 100. As shown in FIG. 4, 20 samples, that differed in combination of the section modulus Z1 and Z2, were produced for impact resistance test based on "Japanese Industrial Standard B8031". Each sample in FIG. 4 had one of the section modulus "Z1" of 71 $mm^3$, 66 $mm^3$, 62 $mm^3$, 58 $mm^3$, 53 $mm^3$, 49 $mm^3$ or 45 $mm^3$, and one of the section modulus "Z2" of 74 $mm^3$, 71 $mm^3$, 66 $mm^3$, 62 $mm^3$, 58 $mm^3$, 53 $mm^3$, 49 $mm^3$ or 45 $mm^3$. Each sample had a different relationship between the distances A and B. In the samples of FIG. 4, the thickness C of the trunk portion 34 was 3.0 mm and the bulging ratio (H/D) of the groove 35 was 0.15.

In the impact resistance test of FIG. 4, the samples were mounted on an impact resistance testing apparatus to apply impact on the samples at 400 times per minute for 60 minutes under normal conditions of humidity and temperature. Thereafter, the presence/absence of cracks in the cross-section of the groove 35 was inspected. FIG. 4 shows values of the section modulus Z1, Z2, the relationship between the distances A and B, and the presence/absence of cracks following the sample numbers. Regarding the presence/absence of cracks, a crack observed at the first groove end 353 side of the groove 35 is indicated as "A side", and a crack observed at the second groove end 357 side is indicated as "B side."

According to the evaluation result in FIG. 4, when compared to the presence and absence of cracks in the samples that had the section modulus Z1 smaller than 66 $mm^3$, the occurrence of crack was prevented if the relationship between the section modulus Z1 and Z2 was Z1<=Z2. This is due to the fact that the impact stress generated in the groove 35 is alleviated because the curving shape of the groove 35 at the second groove end 357 side is gentle compared to that of the groove 35 at the first groove end 353 side. Therefore, the section modulus Z1 and Z2 preferably satisfy the relationship: Z1<=Z2.

Further, according to the evaluation result in FIG. 4, the crack was observed in the samples, such as Sample 71, having the section modulus Z1 of 45 $mm^3$ smaller than 49 $mm^3$, even though the section modulus Z1 and the section modulus Z2 satisfy the relationship of Z1<=Z2. Therefore, the section modulus Z1 preferably satisfies the relationship: Z1>=49 $mm^3$.

According to the evaluation result in FIG. 4, when compared to the presence and absence of cracks in the samples satisfying a relationship A>B, such as Samples 23 and 33, the occurrence of crack was prevented if the section modulus Z2 was 62 $mm^3$ or more. Therefore, it is preferable that the distances A, B and the section modulus Z2 satisfy the relationship: "if A>B, Z2>=62 $mm^3$".

According to the evaluation result in FIG. 4, when compared to the presence and absence of cracks in the samples have the relationship A<=B, such as Samples 52, 61, 62 and 71, the occurrence of crack was prevented if the section modulus Z2 was 53 $mm^3$. Therefore, it is preferable that the distances A, B and the section modulus Z2 satisfy the relationship: "if A<=B, Z2>=53 $mm^3$".

A-3. Evaluated Value of Thickness C of Trunk Portion 34

FIG. 5 is an explanatory view showing the result of the evaluation regarding an influence of the thickness of the trunk portion on impact resistance properties of the spark plug. As shown in FIG. 5, five samples differed in thickness "C" of the trunk portion 34 were produced for performing the impact resistance test, similarly to the test in FIG. 4, to inspect the occurrence of cracks in the groove 35. In the samples of FIG. 5, the thickness C of the trunk portion 34 varied in 4.0 mm, 3.5 mm, 3.0 mm, 2.5 mm and 2.0 mm, the section modulus Z1 of the groove 35 was 71 $mm^3$, and the section modulus Z2 of the groove 35 was 66 $mm^3$. Further, the relationship between the distances A and B in each sample was A>B, and the bulging ratio (H/D) of the groove 35 was 0.15. FIG. 5 shows the value of the thickness C and the presence/absence of cracks following the sample numbers.

According to the evaluation result in FIG. 5, when the thickness C of the trunk portion 34 was 3.0 mm or more, the occurrence of cracks was prevented. This is due to alleviation of an impact bending moment exerted on the groove 35 at the threaded portion 32 serving as a fulcrum because the rigidity of the trunk portion 34 becomes high as the thickness C of the trunk portion 34 increases. Therefore, the thickness C of the trunk portion 34 preferably satisfies a relationship: C>=3.0 mm.

A-4. Evaluated Value of Bulging Ratio (H/D) of Groove 35

FIG. 6 is an explanatory view showing the result of the evaluation regarding an influence of the bulging ratio of the groove 35 on stress-corrosion-crack-resistance properties of the spark plug 100. In the evaluation of FIG. 6, five samples differed in the bulging ratio (H/D) of the groove 35 were produced for the stress-corrosion-crack-resistance test. The samples of FIG. 6 had one of the bulging ratio (H/D) of 0.14, 0.15, 0.16, 0.17 and 0.18. The samples had the section modulus Z1 of 71 $mm^3$, the section modulus Z2 of 66 $mm^3$, the thickness C of 3.0 mm, and the distances A and B satisfying the relationship: A>B. In the stress-corrosion-cracking test, the samples were immersed in a 130 degrees C. test solution (85 g of calcium nitrate tetrahydrate+5 g of ammonium nitrate+10 g of water) for 60 hours to inspect whether or not any crack (stress corrosion cracking) occurred. The value of the bulging ratio (H/D) and the presence/absence of the crack were shown in FIG. 6 following the sample numbers.

According to the evaluation result of FIG. 6, it is found that the stress-corrosion-cracking can be prevented when the bulging ratio (H/D) of the groove 35 is below 0.17 or less. This is resulted from alleviation of residual stress, which is generated at the time of caulking, of the groove 35 with controlling the bulging amount of the groove 35. Therefore, the bulging ratio (H/D) of the groove 35 preferably satisfies the relationship: (H/D)<=0.17.

A-5. Effect

According to the spark plug 100 described above, when the section modulus Z1, Z2 of the groove 35 satisfy the relationship Z1<=Z2, the impact resistance of the groove 35 may be secured, i.e., achieved, even if the opposite side distance of the tool engagement portion is 12 mm or less. Thus, the spark plug 100 can be miniaturized while maintaining the strength and integrity of the groove 35 of the metal shell 30. Further, when the section modulus Z1 of the groove 35 satisfies the relationship Z1>=49 $mm^3$, the impact resistance of the groove 35 may be fully secured. Furthermore, when the section modulus Z2 of the groove 35 satisfies the relationship: "if A>B, Z2>=62 $mm^3$" or "if A<=B, Z2>=53 $mm^3$", the impact resistance of the groove 35 is fully securable corresponding to the relationship between the distance A and the distance B. Moreover, when the thickness C of the trunk portion 34 satisfies the relationship C>=3 mm, the impact exerted on the groove 35 can be alleviated. When the bulging ratio (H/D) of the groove 35 satisfies the relationship (H/D)<=0.17, the stress corrosion cracking resistance can be improved.

Further, the spark plug 100 can be miniaturized while maintaining the intensity of the groove 35 of the metal shell 30 even though the metal shell 30 is plated by nickel that tends to cause cracks due to stress corrosion. Furthermore, the spark plug 100 can be miniaturized while maintaining the intensity of the groove 35 of the metal shell 30, even though the cold caulking, which tends to cause an asymmetry of the bulging of the groove 30 across the outermost portion 355, is adopted for fixing the metal shell 30.

B. Other Embodiment

The present invention is not limited to the above-described embodiments or modes, but may be embodied in various other forms without departing from the gist of the invention.

The invention claimed is:

1. A spark plug comprising:

a rod-like center electrode;

a ceramic insulator electrically insulating an outer circumference of the center electrode;

a metal shell fixed by caulking to an outer circumference of the ceramic insulator, the metal shell including a cylindrical groove that bulges outwardly in an outer circumference direction, said cylindrical groove having a first end and a second end, a polygonal tool engagement portion that adjoins said first end of the groove and bulges outwardly in the outer circumference direction with respect to the groove, and a trunk portion that adjoins said second end of the groove, and that bulges out in the outer circumference direction with respect to the groove; and a ground electrode joined to the metal shell, said ground electrode forming a spark gap with the center electrode, wherein an opposite side distance "S" between opposing two sides of the polygonal tool engagement portion is 12 mm or less, wherein the section modulus "Z1" satisfy a relationship Z1>=49 mm3, wherein a distance A, a distance B and the section modulus "Z2" satisfy the following relationship:

if A>B, then Z2>=62 mm3, if A<=B, then Z2>=53 mm3, where "Z1" represents a section modulus in the first end of the groove, and where "Z2" represents a section modulus in the second end of the groove, where the distance "A" represents a distance along an axis of the spark plug from the first end to an outermost portion having a largest outer diameter in the groove, and where the distance "B" represents a distance along said axis from the second end to the outermost portion.

2. The spark plug according claim 1, wherein a section modulus "Z1" and a section modulus "Z2" satisfy a relationship:

$$Z1<=Z2.$$

3. The spark plug according to any one of claim 1 or 2, wherein a thickness "C" satisfy the relationship:

$$C>=3\text{ mm},$$

where the thickness "C" represents a thickness of the trunk portion along an axis of the center electrode from a region adjoining the second end of the groove.

4. The spark plug according to claim 1 or 2, wherein a distance "D" and a distance "H" satisfy the following relationship:

$$(H/D)<=0.17,$$

where the distance "D" represents a distance from the first end to the second end of the groove, and where the distance "H" represents a distance from the outermost portion to a straight line that connects the first end to the second end of the groove.

5. The spark plug according to claim 1 or 2, wherein the metal shell is plated with nickel.

6. The spark plug according to claim 1 or 2, wherein the fixation by caulking is conducted through a cold caulking.

* * * * *